United States Patent [19]

Moen et al.

[11] 4,052,802

[45] Oct. 11, 1977

[54] GROUND-ENGAGING TOOL WITH WEAR-RESISTANT INSERT

[75] Inventors: Lowell J. Moen; Eugene L. Helton, both of Peoria; Chris R. Straesser, East Peoria, all of Ill.

[73] Assignee: Caterpillar Tractor Co., Peoria, Ill.

[21] Appl. No.: 660,752

[22] Filed: Feb. 23, 1976

[51] Int. Cl.[2] ..... A01B 35/22

[52] U.S. Cl. ..... 37/141 R; 75/208 R; 172/747

[58] Field of Search ..... 37/141 R, 141 T, 142 R, 37/142 A; 75/208 R; 29/182.5, 182.7, 182.8; 175/409–411; 172/767, 747

[56] References Cited

U.S. PATENT DOCUMENTS

| | | | |
|---|---|---|---|
| 2,833,638 | 5/1958 | Owen | 29/182.8 |
| 3,529,677 | 9/1970 | Stephenson | 37/141 R X |
| 3,790,353 | 2/1974 | Jackson et al. | 37/141 R X |
| 3,844,011 | 10/1974 | Davies | 75/208 R X |

*Primary Examiner*—R.E. Suter
*Attorney, Agent, or Firm*—Charles E. Lanchantin, Jr.

[57] ABSTRACT

A ground-engaging tool is disclosed which includes a blade with a load carrying front face, a ground-engaging bottom surface, and a rear face, and a wear-resistant insert is secured thereto to extend the service life thereof. The wear-resistant insert includes a back-up plate which is disposed in rearwardly spaced relation from the rear face of the blade and adjacent its bottom surface, a wear-resistant material which is bondably sandwiched between the plate and the rear face, and a plurality of bridging members which extend through the wear-resistant material and are rigidly secured to the plate and the rear face of the blade to minimize in use spalling of the wear-resistant material.

8 Claims, 4 Drawing Figures

GROUND-ENGAGING TOOL WITH WEAR-RESISTANT INSERT

BACKGROUND OF THE INVENTION

Much industrial effort has been devoted to developing ground-engaging tools with a reduced cost to wear-life ratio. For example, new material compositions and heat treatments have been responsible for lowering the wear rates of cutting edges for earthmoving blades and the tips for penetrating teeth. Moreover, various hard-facing materials have been weldingly applied to the exposed wear surfaces of such tools; but unfortunately, these thin hard facings wear away relatively quickly and it is necessary to apply additional layers at considerable expense.

Particularly promising are those activities relating to the use of composite wear-resistant materials which embody a plurality of highly abrasive-resistant particles in a tough carrying matrix material. These composite materials are typically deposited on the tool or are made into inserts. Illustrative thereof are U.S. Pat. No. 3,757,879 issued Sept. 11, 1973 to A. G. Wilder et al., and U.S. Pat. No. 3,800,891 issued Apr. 2, 1974 to A. D. White et al.

In addition to economic considerations, these composite materials must be located in optimum locations on the tool because they tend to crack off or fail by spalling under the severe working conditions so frequently encountered. Representative of the diverse efforts to situate wear-resistant members, composite or otherwise, in an optimum location relative to the normal direction of tool travel, are the following U.S. Pat. Nos.

1,583,701 issued May 4, 1926 to O. A. K. Printz
1,965,950 issued July 10, 1934 to C. M. Walker
2,033,594 issued Mar. 10, 1936 to S. M. Stoody
2,549,088 issued Apr. 17, 1951 to H. C. Hettelsater et al.
3,529,677 issued Sept. 22, 1970 to E. W. Stephenson
3,888,027 issued June 10, 1975 to L. F. Toews

SUMMARY AND OBJECTS OF THE INVENTION

Accordingly, it is an object of the present invention to provide an improved ground-engaging tool which has a low cost to wear-life ratio.

Another object of the invention is to provide such an improved tool with a plurality of wear-resistant inserts which are less prone to spalling.

Another object is to provide wear-resistant inserts for the aforementioned tool which are conveniently separately made and which are capable of being easily and positively secured to the tool.

Another object is to provide a tool of the character described wherein the wear-resistant inserts are disposed in a protected location on the tool relative to its normal travel direction in order to extend the service life thereof.

Other objects and advantages of the present invention will become more readily apparent upon reference to the accompanying drawings and following description.

DESCRIPTION OF THE PREFERRED EMBODIMENT

Figure 1:
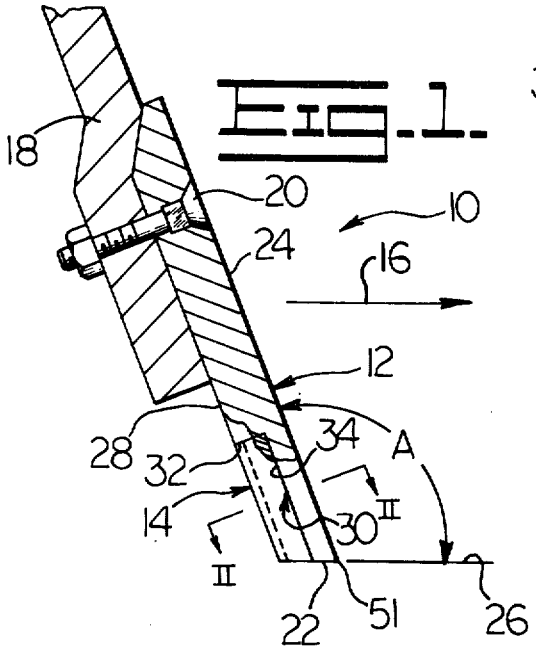
FIG. 1 is a fragmentary vertical longitudinal section of the ground-engaging tool and a wear-resistant insert of the present invention.

With reference to FIG. 1, a ground-engaging tool 10 is shown as including a blade 12 having a wear-resistant member or insert 14 protectingly secured to the lower rear portion thereof in accordance with the present invention. An arrow 16 indicates the normal direction of linear travel of the blade with respect to the earth. The blade is preferably of hot rolled, low or medium carbon steel and of transversely elongated construction such as may be used in conjunction with a conventional motor grader moldboard 18. Both the moldboard and blade are suitably apertured in order to receive a plurality of transversely spaced fastening devices 20 therethrough, and upon screw threaded release thereof the blade may be replaced in the usual manner after an extended service life.

More particularly, the blade 12 has a ground-engaging bottom surface 22 and a load-carrying front face or surface 24 which is typically sloped forwardly and downwardly with respect to a substantially horizontal ground line 26. For example, in order to enable the tool 10 to better move earth, snow or the like, an inclination angle identified by the letter A of approximately 120° is frequently utilized. Such a large angle of inclination is not especially deleterious to the service life of conventional inserts. However, when the blade is inclined to an angle of 90°, as is occasionally the case, severe chipping of conventional inserts occurs.

The blade 12 further has a rear surface 28 which is substantially parallel to the front face 24 and is appropriately supported thereon to resist working loads by the moldboard 18. Moreover, the blade also has a rearwardly facing recess 30 therein which is defined by a transversely extending end wall 32 and a transversely extending rear face 34.

Figure 2:
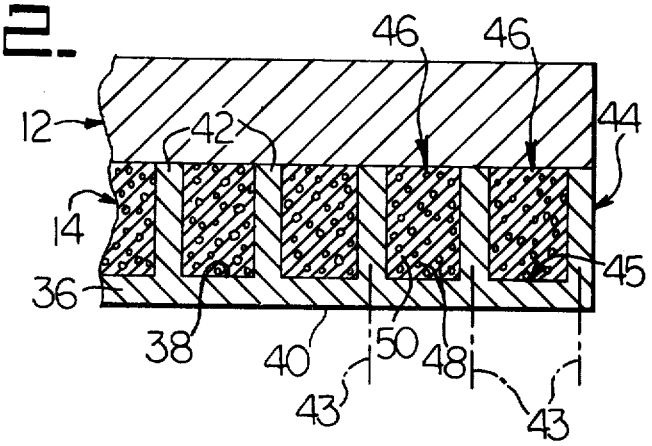
FIG. 2 is a substantially enlarged and substantially horizontal fragmentary sectional view of the ground-engaging tool of FIG. 1 taken along the line II—II thereof.

In accordance with the present invention, the wear-resistant insert 14 is disposed in the blade recess 30 and is secured to the blade 12 as by brazing or the like as will be described further below. As best shown in FIG. 2, however, it is apparent that the insert is of composite construction including a back-up plate 36 having a front face 38 and a rear or external face 40, and which is oriented in parallel spaced relation from the rear face 34 of the recess. A plurality of bridging members or parallel ribs 42 are rigidly secured in a manner normal to the plate so that they projectingly extend forwardly from it in a plurality of vertically oriented parallel planes 43 which are parallel to the normal direction of linear travel of the tool. In this way the back-up plate and ribs serve as a holder 44 which provides a plurality of cells or pockets 45 which are subsequently filled with a wear-resistant composite material 46. Such composite material 46 consists essentially of a plurality of abrasive-resistant particles 48 embedded in a carrying matrix 50.

The abrasive-resistant particle portion of the present invention is preferably a relatively low-carbon, chromium-iron based alloy having a predetermined amount of boron therein. More particularly, the chemical composition of the alloy of the particles 48 is percent by weight is set forth below:

Chromium: 25–70%
Boron: 6–12%
Silicon: less than 2%
Carbon: less than 0.2%
Iron: remainder This combination of elements, in a preferred proportion containing 58% chromium and 8% boron, gives a complex mixture of iron and chromium borides having extremely high hardness values, typically from 1200 to approximately 1600 Kg/mm Knoop (or above approximately 70 on the Rockwell "C" hardness scale). Preferably this mixture is formed into semi-round or spheroidal particles having diameters within the range of from 0.5 mm (0.02 inch) to 2 mm (0.08 inch) and a maximum melting temperature of 1899° C (3450° F).

It should be appreciated that while it is advantageous to use the aforementioned particle composition, other extremely abrasive-resistant materials may also be used without departing from the spirit of the present invention. Preferably, these other materials would be ferrous-based alloys having a carbon content limited to less than 0.2% for reasons which will be set forth later in this application.

Referring now to the relatively tough and ductile particle carrying matrix 50, which also exhibits a reasonably high hardness for an extended wear life, such matrix has the following chemical composition in percent by weight:

Boron: 3–5%
Carbon: less than 0.2%
Iron: remainder

Preferably the iron-boron matrix is of eutectic composition, wherein the boron is controlled to a level of approximately 3.8%. This eutectic composition provides an alloy having a relatively fine ferritic microstructure and a high average hardness within a range of from 35 to 45 on the Rockwell "C" scale due to boride needles therein. Also, because of the aforementioned range of boron content, the melting temperature thereof is accurately established within a relatively small range of from approximately 1161° C (2122° F) to 1200° C (2200° F). It is to be appreciated that while such matrix composition is considered preferable, other matrix materials may be utilized.

Having considered the composition of the wear-resistant composite material 46, attention may now be given to the particular disposition of the insert 14 to the ground-engaging tool 10 as illustrated in FIG. 1. It is apparent that the lower portion of the insert is disposed behind a cutting edge 51 defined transversely by the intersection of the bottom surface 22 and the front face 24 of the blade 12. In such location the depending cutting edge portion of the tough blade shields and protects the insert during normal travel of the tool, while at the same time the insert supports and backs it up. Moreover, in such disposition of the insert, the wear-resistant composite material 46 in the pockets 45 extends downwardly like a series of substantially parallel "fingers" to make contact with the ground directly behind the bottom surface 22 of the blade. Since the composite material is considerably harder than the blade, the wear rate of the lower portion of the tool is, thus, greatly reduced. Moreover, in accordance with the present invention, the tough steel back-up plate 36 and associated ribs 42 supports and protects the hard composite material which would otherwise tend to shatter or spall off the rear of the blade at an excessive rate. This is particularly advantageous when the inclination angle A of the blade is operated near an angle or 90° where spalling conditions are substantially at a maximum due to the violent shock loads experienced in operation.

Figure 4:
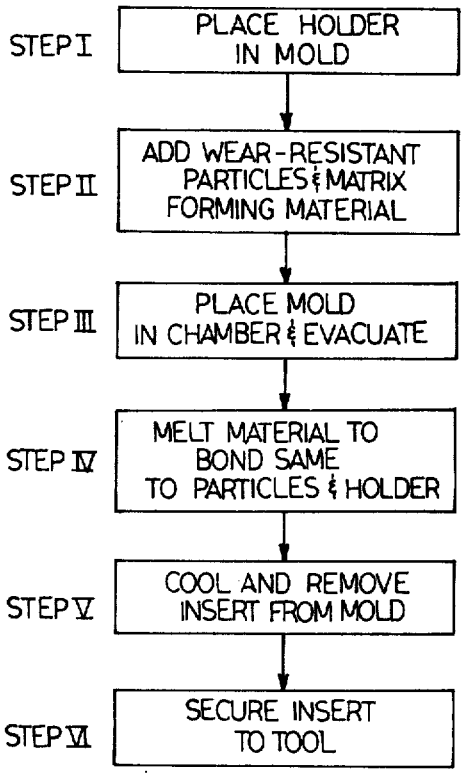
FIG. 4 is a block flow diagram showing the preferred process steps which are utilized during the manufacture of the ground-engaging tool of FIG. 1 in accordance with the present invention.

While the operation of the present invention is believed clearly apparent from the foregoing description, further amplification of the method of manufacturing and installing the insert 14 will subsequently be made. Initially, the low carbon steel back-up plate 36 and the integral low carbon steel ribs 42 are placed in the cavity of a ceramic mold 52 having wall dimensions adapted to closely receive them as is clearly apparent when viewing FIG. 3. It is to be noted that the ribs may be an integral part of the back up plate such as can be formed directly by extrusion, or they may be welded on. However, placing the holder 44 in the mold completes step 1 as illustrated in the first block of the flow diagram of FIG. 4.

Figure 3:
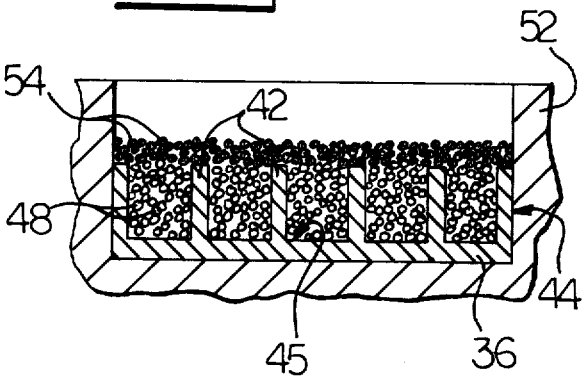
FIG. 3 is a diagrammatic and sectionalized view of a holder, a plurality of wear-resistant particles, and a quantity of matrix forming material which is placed in the cavity of a mold in accordance with an early stage of the manufacture of the wear-resistant insert of the present invention.

In step 2 a quantity of the chromium-iron-boron particles 48 are deposited within the pockets 45 of the holder 44 and then a quantity of the iron-boron alloy material 54 is placed on top thereof for subsequent melting as diagrammatically shown in FIG. 3. Preferably, the mix consists essentially of 45 to 70 percent by volume of the particles. Furthermore, it has been found to be particularly desirable to deposite the iron-boron alloy material in the mold 52 in the form of a plurality of spheroidal shot having substantially the same range of diameters as the extremely abrasive-resistant particles, and with the latter remaining substantially physically unchanged during further processing.

In step 3 the mold 52, the particles 48 and matrix forming shot 54 are then deposited in the chamber of a vacuum furnace, not shown, and the chamber is subsequently substantially evacuated. At this time a relatively limited amount of nitrogen gas may be introduced into the chamber at a very low pressure to protect the furnace and elements of the composite material from vaporization problems. This nitrogen environment particularly inhibits the evaporation of the chromium and boron.

In step 4 the furnace chamber and materials are initially preheated at a temperature of approximately 1093° C (2000° F) for a period of approximately 1 hour in order to obtain a uniform temperature thereof. This minimizes the time required to hold an immediately following final heating temperature of approximately 1204° C (2200° F), which is maintained for approximately 15 to 30 minutes. During the final heating stage the iron-boron alloy shot 54 is melted, with the melt seeping downwardly through gravity to fully infiltrate and encapsulate the chromium-iron-boron particles 48 and to adhere to the back-up plate 36 and to the ribs 42. The compatability and ferrous based nature of the matrix material is such as to form a relatively strong bond to the holder and the particles. Because of the reduced time at final temperature, the erosion of the particles by the fully embracing matrix material is minimized, and this further serves to retain certain original physical characteristics of the particles, the back-up plate and the ribs.

In step 5 the furnace is cooled and the completed insert 14 is removed from the mold 52.

In step 6, the composite insert 14 is preferably joined to the end wall 32 and rear face 34 of the blade 12 by brazing. Preferably a copper brazing compound consisting essentially of 23% manganese, 9% nickel and the balance copper is utilized. This is achieved without deleteriously affecting the strength and hardness of either the matrix material or the particles 48. The relatively low percentage of carbon which is established in the holder 44, for example preferably less than 0.2%, and the low carbon percentage in both the particles and the matrix material increases the chipping resistance of the composite. It is to be noted that a ceramic mold 52, rather than a graphite mold, is utilized. In this way substantially no carbon contamination of the composite material can take place during the heating phases, nor can relatively high temperatures cause any substantial changes to its microstructure. This is in marked contrast to other ferrous alloy materials having higher carbon contents which are significantly physically modified by heat.

The aforementioned procedure has proven effective in obtaining a relatively low cost and wear-resistant ground-engaging tool with the particles 48 thereof retaining an extremely high hardness value of approximately 1400 Kg/mm Knoop and with the matrix 50 exhibiting a relatively high and typical hardness level of approximately 35 to 45 on the Rockwell "C" hardness scale. Moreover, in accordance with the present invention, the steel back-up plate 36 protects the composite material 46 from spalling or fracturing so that excellent wear ratios have been obtained while the ribs 42 serve to anchor the plate in the material and to the blade 12 so that it will not peel off.

While the invention has been described and shown with particular reference to a preferred embodiment, it will be apparent that variations might be possible that would fall within the scope of the present invention, which is not intended to be limited except as defined in the following claims.

What is claimed is:

1. A ground-engaging tool comprising:

a blade including a load carrying front face, a ground-engaging bottom surface, and a rear face; and wear-resistant means for extending the wear life of the tool including a back-up plate disposed in rearwardly spaced relation from said rear face and adjacent said bottom surface, a wear-resistant material bondably sandwiched between said plate and said rear face, and a plurality of substantially parallel ribs which extend through said wear-resistant material and are rigidly secured to said plate and said rear face of said blade, said ribs being oriented in vertical planes parallel to a normal direction of linear travel of the tool, to minimize in use spalling of said wear-resistant material.

2. A ground-engaging tool comprising:

a blade elongated transversely to a normal direction of linear travel of the tool and including a forwardly depending cutting edge portion and a rear face protectingly disposed behind it; and a wear-resistant member secured to said rear face including a back-up plate, a composite wear-resistant material consisting essentially of a plurality of abrasive-resistant particles embedded in a carrying matrix bondably secured spannably to said plate and said rear face, and a plurality of substantially parallel ribs oriented in vertical planes parallel to said normal direction of linear travel of the tool which bridgingly extend through said wear-resistant material and are secured to said plate and said wear-resistant material to minimize in use spalling of said wear-resistant material.

3. The ground-engaging tool of claim 2 wherein said blade, said back-up plate and said ribs are made of relatively tough ductile ferrous materials.

4. The ground-engaging tool of claim 3 wherein said ferrous materials are steel.

5. The ground-engaging tool of claim 4 wherein said wear-resistant member is secured as a unit to said rear face of said blade by brazing.

6. A wear-resistant insert for a ground-engaging tool comprising:

a back-up plate of low carbon steel with a plurality of projecting members of low carbon steel extending generally normally therefrom; and a composite material including a plurality of abrasive-resistant particles of low carbon ferrous-based alloy material in a carrying matrix of low carbon ferrous-based alloy material different than said material of the particles and being bonded to said back-up plate and to said projecting members and covering said back-up plate between said projecting members to a depth of the projecting members, wherein said back-up plate, said projecting members, said abrasive resistant particles and said matrix are each of a material having less than 0.2% carbon by weight.

7. The wear-resistant insert of claim 6 wherein said abrasive-resistant particles have hardness values from 1200 to approximately 1600 kg/mm Knoop.

8. The wear-resistant insert of claim 7 wherein said matrix has a hardness value within a range of from 35 to 45 on the Rockwell "C" scale.

* * * * *